United States Patent [19]

Ohsawa et al.

[11] Patent Number: 4,774,882

[45] Date of Patent: Oct. 4, 1988

[54] METHOD FOR CONTROLLING PRINTING IMPACT POWER IN IMPACT TYPE DOT PRINTER

[75] Inventors: Seiichi Ohsawa; Masahiko Kaneko, both of Saitama; Takashi Yokoyama, Tokyo, all of Japan

[73] Assignee: Citizen Watch Co., Ltd., Tokyo, Japan

[21] Appl. No.: 74,510

[22] Filed: Jul. 17, 1987

Related U.S. Application Data

[63] Continuation-in-part of Ser. No. 873,055, Jun. 4, 1986, abandoned, which is a continuation of Ser. No. 662,233, Oct. 18, 1984, abandoned.

[30] Foreign Application Priority Data

Oct. 18, 1983 [JP] Japan ..... 58-194523

[51] Int. Cl.[4] ..... B41J 9/26

[52] U.S. Cl. ..... 101/93.03; 101/93.04; 400/157.3; 400/166

[58] Field of Search ..... 400/121, 157.2, 157.3, 400/166, 303, 124; 101/93.03, 93.04, 93.05

[56] References Cited

U.S. PATENT DOCUMENTS

| | | | |
|---|---|---|---|
| 4,162,131 | 7/1979 | Carson | 101/93.03 X |
| 4,162,858 | 7/1979 | Brandenburg | 101/93.03 X |
| 4,278,359 | 7/1981 | Weikel | 400/121 X |

FOREIGN PATENT DOCUMENTS

| | | | |
|---|---|---|---|
| 64570 | 4/1982 | Japan | 400/303 |
| 165278 | 10/1982 | Japan | 101/93.03 |
| 45985 | 3/1983 | Japan | 400/303 |

OTHER PUBLICATIONS

IBM Tech. Disc. Bulletin, B. R. Cavill, vol. 24, No. 11A, Apr. 1982, pp. 5430–5432, 400–121.

*Primary Examiner*—Paul T. Sewell
*Attorney, Agent, or Firm*—Koda and Androlia

[57] ABSTRACT

A method for controlling printing impact in an impact type dot printer which controls printing impact energy to be increase in case of normal density imprint function and to be decreased in case of high density imprint function in the controlling means of the impact type dot printer in which the printing stylus strikes the printing paper so that the printing paper can be prevented from being damaged during the high density imprint function.

4 Claims, 5 Drawing Sheets

METHOD FOR CONTROLLING PRINTING IMPACT POWER IN IMPACT TYPE DOT PRINTER

This is a continuation-in-part of application Ser. No. 873,055 filed June 4, 1986, now abandoned, which in turn is a continuation of Ser. No. 662,233 filed Oct. 18, 1984, now abandoned.

BACKGROUND OF THE INVENTION

1. Field of the Invention

The present invention relates to a method for controlling the printing impact power in an impact type dot printer, and more particularly to a method for controlling the printing impact power in an impact type dot printer to change the printing impact power of printing stylus in a high density imprint function from the printing impact in an normal density imprint function.

2. Prior Art

In recent years, an impact type dot printer has been of wide use in the various printing devices in order to increase the printing speed and to simplify the printing control.

In ordinary cases, the apparatus of this kind is equipped with a printing function of such a normal imprinting density, as shown in FIG. 1, that the dot gaps are put in the contact state, and with a printing function of such a high imprinting density, as shown in FIG. 2, that each of the dots is put in the overlap state.

This high density imprint function is characterized in that the overlap imprints enable easy reading in comparison with the characters printed through normal imprint density since the dot formed on the papers through the overlap imprints are imprinted in the overlapping joined relation. When the characters are required to be printed in good appearance, the high density imprint function is highly recommended. On the contrary, when the characters are not needed to be of a good appearance and the printing operation must be finished in a short time, the characters are imprinted with the normal density imprint function.

The selection of said normal or high density printing mode is normally controlled by the use of normal/high density selecting commands which are included in printing data supplied from a host computer to the printer. Therefore, such commands can perform the desired density selection with respect to particular characters or particularly ranged character rows in the printing data or with respect to particular articles as a whole. It is also possible that said selecting commands are not included in the printing data. In such a case, the printer will be manually controlled by an operator through a keyboard or control panel which is adapted to control the printing operation of the printer. Normally, such a manual operation can perform only a collective selection from the normal density printing to the high density printing or vice versa with respect to a whole article to be printed.

The prior art printer is adapted to perform the changing operation of character generator and paper feed pitch when said selecting command is inputted into the printer. In other words, the prior art printer must supply stylus driving signals to the printing head, based on the inputted printing data. Thus, the printer will include character generators which are adapted to generate dot pattern signals associated with the printing data. For the aforementioned selection of the normal/high density printings, the printer must have two separate character generators, that is, a normal density character generator and a high density character generator. On receiving said selecting commands, necessary dot pattern signals are applied to the printing head from one of these character generators. Since the paper feed pitch in the normal density printing mode is different from that in the high density printing mode, the selecting commands should change the paper feed pitch in the printer to an optimum value for the corresponding printing mode.

In such a manner, the prior art printer can perform the selection of the printing density as shown in FIGS. 1 and 2 only after the change of the character generator and papaer feed pitch has been done, in accordance with the density selecting command which is inputted to the printer through the host computer or keyboard.

However, in the printing function of such a device in the prior art, the high density imprint damages the printing papers as a result of overlapped impacts by the printing stylus in plurality to the same spot on the printing papers, since the impact power to the printing paper is fixingly determined with the basis of printing impact power at the normal density imprint function.

In the prior art, therefore, a sheet of printing paper can be torn if the printing data including two kinds of printing density data, that is, normal and high dot density data different from each other are used on printing only by the change of the character generator and paper feed pitch.

A device capable of changing the printing pressure or stylus driving force depending on different printing patters has been proposed,for example, by Japanese Laid-Open Patent Application No. 57-64570.

However, such a device is not adapted to change the impact power of dot printing with respect to the normal and high density printing modes, but to change the stylus driving force depending on different printing patterns. If a simple character as "I" or "L" and a complicated character as "M" or "W" are printed by the use of the same stylus driving force, the former appears to be thin but the latter appears to be thick. To overcome such a difference in the printed characters, the prior art device is adapted to change the stylus driving force. Furthermore, the prior art device is adapted to reduce the stylus driving force to prevent the printing paper from easily being torn when a ruled line or underline is printed thereon. This is not because the dot density is increased, but because the ruled line or underline is in the form of a continuous row of dots extending through an increased distance to weaken the printing paper along the ruled line or underline. This fact is essentially different from such a problem that the printing paper is weakened at overlapped dots which are printed thereon in the high density printing mode.

The prior art device also is required to have a counter or other circuit for counting the number of dots in a printed pattern. This will make the device more complicated and expensive and also results in increase of the necessary printing period. In other words, the prior art device must judge the dot density in the corresponding printing data to discriminate whether a character or dot pattern therein is in the form of or "M". This requires a complicated circuit and an increased processing time period.

There has not been known a method of changing the stylus driving force on selection of the printing mode from the normal density to the high density or vice versa to provide printed characters having an improved quality without tearing of the printing paper, particularly in the high density printing mode.

SUMMARY OF THE INVENTION

Accordingly, it is a general object of the present invention to provide a method for controlling printing impact power in an impact type dot printer to perform proper printing without giving damage to the printing paper in case of high density imprint function.

In keeping with the principle of the present invention, the object is accomplished by a unique method for controlling the printing impact in the impact type dot printer which increases the printing impact power in large amount in case of normal density imprint function and decreases the printing impact power in small amount in case of high density imprint function.

The present invention also is characterized by that the printing impact power can be changed by the use of the normal/high density selecting commands. In accordance with the present invention, the selecting commands are used not only to change the character generator and paper feed pitch as in the prior art, but also to change the impact power without need of any particular command.

DETAILED DESCRIPTION OF THE INVENTION

Figure 1:
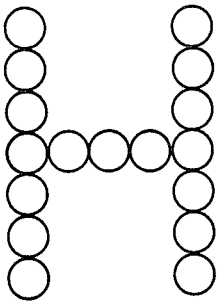
FIG. 1 is an illustration showing an example of a character "H" imprinted by normal density imprint function of the inpact type dot printer.
Figure 2:
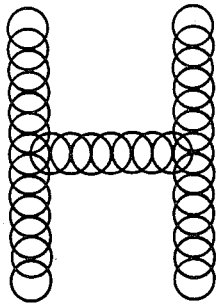
FIG. 2 is an illustration showing an example of a character "H" imprinted by high density imprint function of the impact type dot printer.
Figure 3:
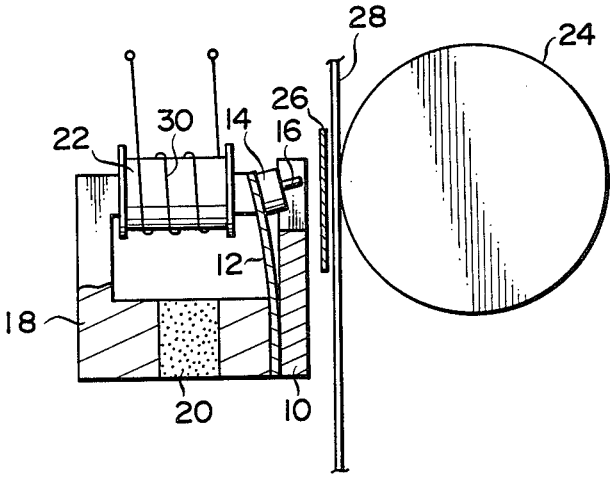
FIG. 3 shows principal portions of the impact type dot printer in accordance with the teachings of the present invention.

Referring more particularly to the drawings, in FIG. 3 shown therein are the principal parts of an impact type dot printer in accordance with the teachings of the present invention. An armature yoke 10 holds a base portion of a leaf spring 12 on its base portion and an armature 14 is arranged on the top end of the leaf spring 12. A printing stylus 16 is fixed in the central position of the armature 14 in the projecting state.

On the base portion of the leaf spring 12, the base portion of a core 18 is attachingly supported on the opposite side from the armature yoke 10, and the core 18 is formed to be curved in a channel shape extended from the base portion to its top end. In the base portion side of the core 18, inserted therein is a permanent magnet 20, and on the top end portion, installed thereon is a solenoid 22 to form an electromagnet device.

Normally, the armature 14 is attracted to the top end of the core 18 by the attracting magnet force of the permanent magnet 20. In this state, the leaf spring 12 is held in a deflected shape as shown in the Figure.

In the facing position to the printing stylus 16 mentioned above, rotatably installed therein is a platen 24. A ribbon 26 and a printing paper 28 are slidingly inserted between the printing stylus 16 and the platen 24.

Accordingly, in this embodiment, a supply of energizing currents to a coil 30 of the solenoid 22 to produce a releasing magnet force against the attracting magnet force of the permanent magnet 20 cancels the magnet flux by the permanent magnet 20 so that the elastic, repulsive energy stored by the deflection of the leaf spring 12 can be released. Such an elastic restoring force of the leaf spring 12 makes the printing stylus 16 strike the printing paper 28 with the ribbon 26 on the platen 24, and the requested dots can be imprinted on the printing paper 28.

As mentioned above, the energizing amount of the printing impact is determined by the attracting energy with the attracting force of the permanent magnet 20 and the elastic energy stored in the leaf spring 12 as the basis, and the releasing energy with the releasing magnet force as the basis. In other words, when the printing impact energy is $E_0$, the elastic energy $E_1$, the attracting energy $E_2$, and the releasing energy $E_3$, a formula is held as $E_0=E_1-(E_2-E_3)$.

Accordingly, the increase of the releasing energy makes the energy of the printing impact be almost equal to the elastic energy mentioned above so that the energy of the printing of the releasing energy of the printing impact holds a large value. On the other hand, the decrease of the releasing energy makes the energy of the printing impact be a small value.

The present invention is characterized in that the printing impact force of the printing stylus 16 to the printing paper 28 can be changeably controlled between the printing operations of the normal density imprint and high density imprint, and that the printing paper can be prevented from being damaged by the high density imprinting.

In this embodiment, the printing impact force is changed by controlling the energizing power supplied to the coil 30 of the solenoid 22.

Figure 4:
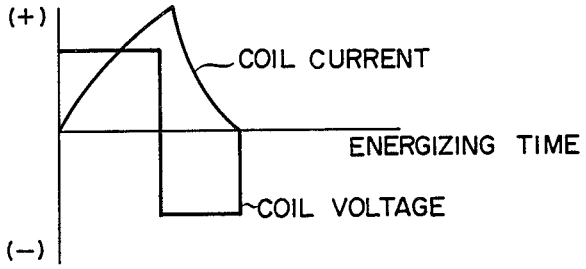
FIG. 4 is an illustration showing an energizing power supplied to a solenoid in case of the normal density imprint function in accordance with the teachings of the present invention.

In other words, FIG. 4 shows the wave forms of the coil voltage and the coil current supplied to the solenoid 22 in the normal density imprint function, and the energizing power to be supplied to the solenoid 22 is determined by the amount of the respective value of the coil current, coil voltage and energizing time.

Figure 5:
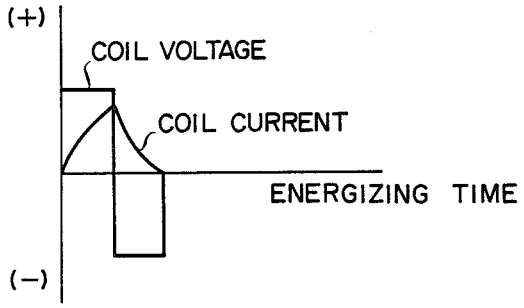
FIG. 5 is an illustration showing an energizing power supplied to a solenoid in case of the high density imprint function in accordance with the teachings of the present invention.

In this embodiment, the energizing power is selected as a smaller value in the high density imprint function than in the normal density imprint function. It is possible to decrease the energizing power by reducing the respective value of the current, etc. to be supplied to the coil mentioned above; but, in this embodiment, as shown in FIG. 5, the energizing power is reduced by supplying the energizing electric current to the solenoid in a less time.

As mentioned above, the supply of the energizing power to the solenoid 22 produces releasing magnet force to the direction cancelling the attracting magnet force by the permanent magnet 20. When the energizing power is large, the releasing magnet force becomes large. The releasing magnet force action of the solenoid 22 cancels the attracting magnet force of the permanent magnet 20, and the elastic restoring force of the leaf spring 12 makes the printing stylus 16 strike the printing paper 28 with less influence of the armature 14 by the attracting force of the permanent magnet 20.

On the contrary, when the solenoid 22 is decreased in its supplied energy, the releasing magnet force can not cancel the attracting force completely, and the magnet force of the permanent magnet 20 remains to cause the armature 14 to act against the elastic restoring force of the leaf spring 12. The printing stylus 16, therefore, strikes the printing paper 28 by the impact in accordance with the difference in force between the elastic restoring force of the leaf spring 12 and the residual magnet force mentioned above. Accordingly, in the high density imprint function, the printing impact of the printing stylus 16 is decreased in comparison with the normal density imprint function. Even if a plurality of impacts are performed on the same spot of the printing paper 28 by the printing stylus 16, the printing paper 28 is prevented from being damaged. In this case, a weak printing impact makes the imprint of one dot to be lightly printed, butthe finally imprinted characters result in the same clearness as the normal density imprint function does, and the characters can be preferably imprinted, since a plurality of dots are imprinted in an overlapping state in the high density imprint function as mentioned above.

Figure 6:
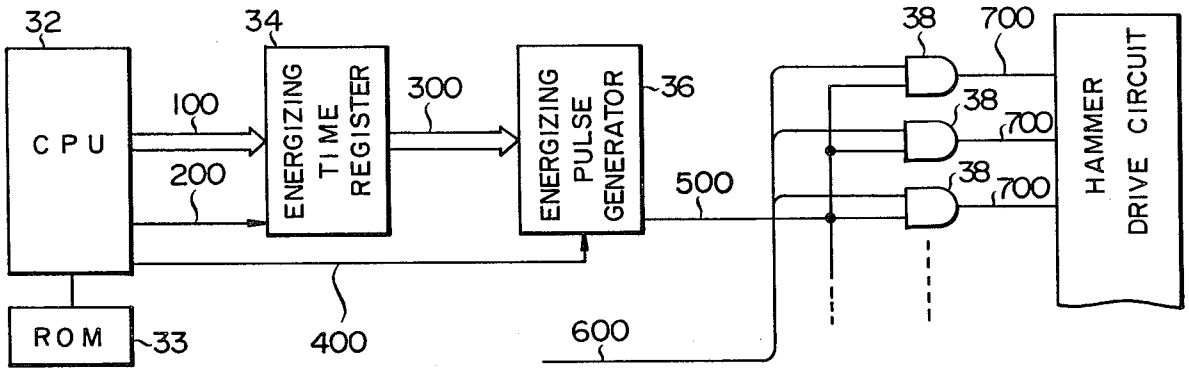
FIG. 6 is a block diagram showing a preferred embodiment in accordance with the teachings of the present invention.
Figure 7:
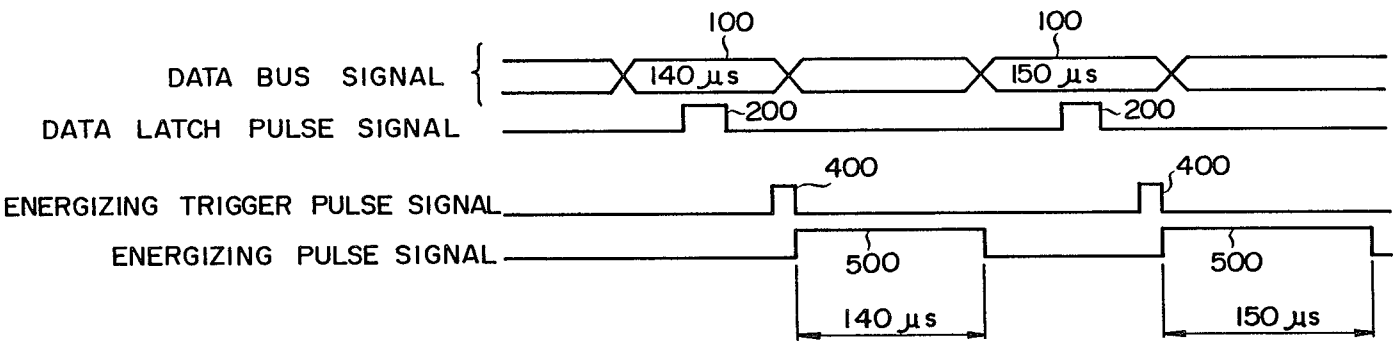
FIG. 7 is a time chart of the respective signal shown in FIG. 6.

FIG. 6 is a block diagram showing the controlling means of the printing impact energy in accordance with the teachings of the present invention, and FIG. 7 is a time chart of the command signals to drive the device shown in FIG. 6. Referring to FIGS. 6 and 7, an embodiment will be hereinafter described specifically in accordance with the teachings of the present invention.

In FIG. 6, in a ROM 33 is stored on-time duration data of the energizing current to be supplied to the solenoid 22. The data value of 150 μS is established for the normal density imprint function, and the data value of 140 μS is established for the high density imprint function.

This established data bus signal 100 is supplied to an energizing time register 34, as shown in FIG. 7, and memorized in the energizing time register 34 one time after another.

When the dot printing is performed in accordance with the normal density imprint function, the data latch pulse signal 200 is outputted from a CPU 32 to the energizing time register 34, and the established data value of 140 μS memorized by the data bus signal 100 mentioned above is latched. This latching action makes the energizing time register 34 output the command signal 300 of 140 μS to an energizing pulse generator 36.

The energizing pulse generator outputs the energizing pulse signal 500 of 140 μS to the respective digit of the gate circuit 38 on the basis of the energizing trigger pulse signal 400 supplied from the CPU 32.

On the other hand, a printing command 600 is outputted to each of the gate circuits 38 at a predetermined timing. When both the printing command 600 and the energizing pulse signal 500 mentioned above are supplied, high density imprint drive signals 700 are outputted from the gate circuits 38 to a hammer drive circuit 40, and an energizing current is supplied from the hammer drive circuit 40 to the solenoid 22 with the energizing time of 140 || S by this signal 700. Thus, the high density imprint function is performed.

In the case of switching over to the normal density imprint function from the high density impring function, the established data of 150 μS is latched to the energizing time register 34 by the data latch pulse signal 200 supplied from the CPU 32, and the energizing pulse signal 500 of 150 μS is outputted to the gate circuits 38 from the energizing time pulse generator 36. At this time, the energizing current with the energizing time of 150 μS is supplied from the hammer drive circuit 40 to the solenoid 22 in the same way as in the high density imprint function, and the normal density imprint function is thus performed.

In accordance with the present invention, the change of impact power for either of the normal or high density printing mode can be made by a normal or high density selecting command. Such a command is inherently used to change the character generator and paper feed pitch which is necessary in selecting the printing from the normal density mode to the high density mode or vice versa. In accordance with the present invention, however, the same command is utilized to change the impact power. Thus, the present invention can provide a simplified arrangement without supplement of any new command.

The selecting commands may be included in printing signals which are supplied from a host computer to the printer, but also may be manually applied to the printer through a keyboard or control panel.

In the former case, the selection of the printing mode may be made from the normal density to the high density or vice versa for each of desired characters, character ranges or articles. In the latter case, the selection may be performed for each of articles to be printed.

Figure 8A:
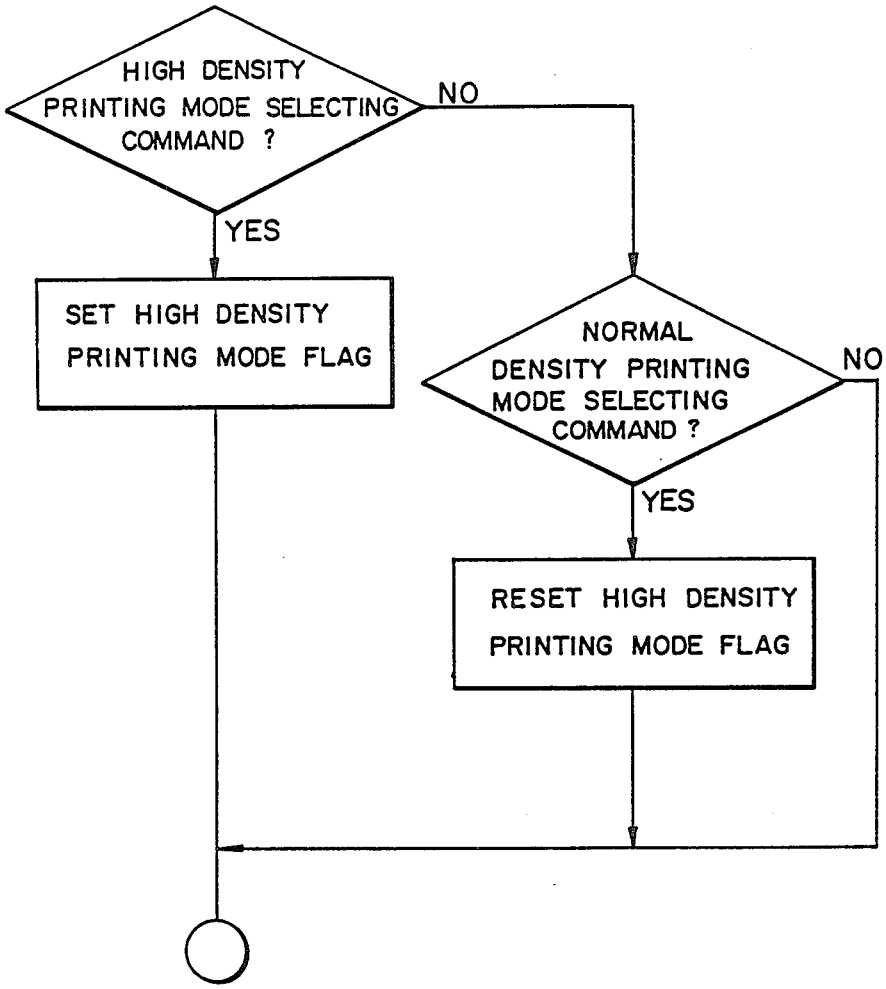
FIGS. 8A and 8B are flow charts of the preferred embodiment in accordance with the teachings of the present invention.
Figure 8B:
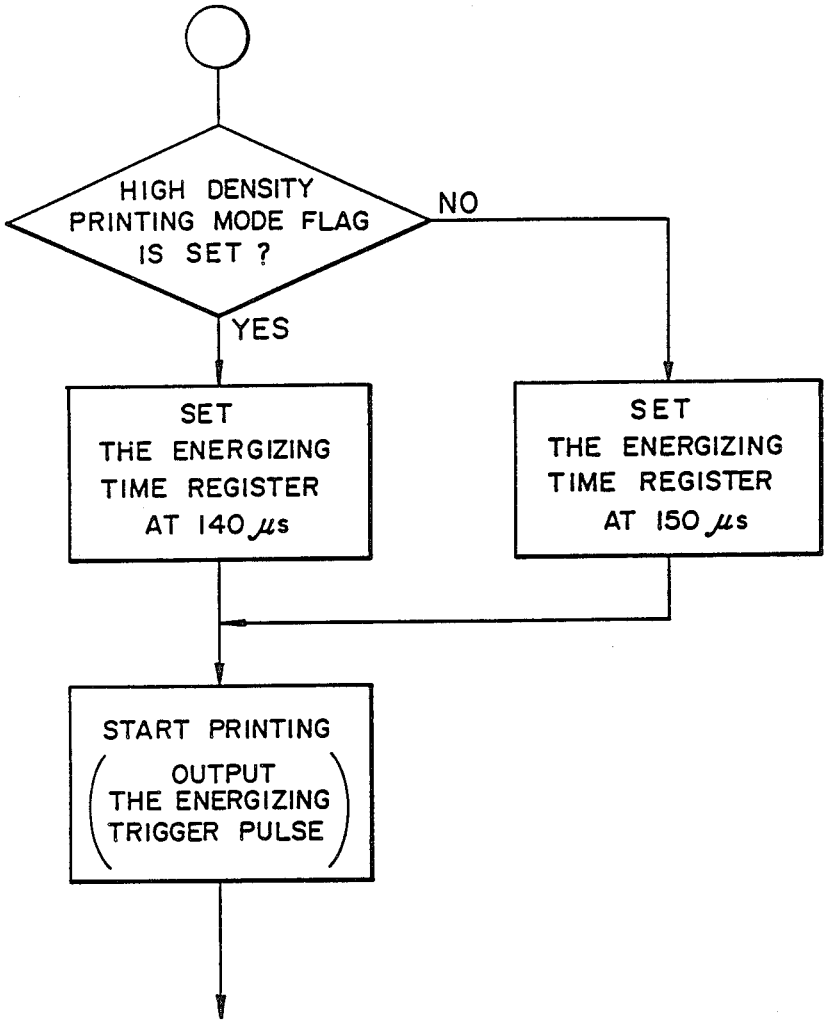

FIGS. 8A and 8B show flow charts of this embodiment, and the operation of the present invention will be hereinafter described in reference to these flow charts.

FIG. 8A shows a flow chart of discriminating normal/high density selecting commands while FIG. 8B illustrates a timing chart of changing the energizing time by the use of said selecting command in the present embodiment.

Referring first to FIG. 8A, high and normal density printing commands are discriminated by CPU32 in the order as described. In other words, CPU32 is adapted to read and store a selecting command which is included in the printing data from the host computer or which is manually inputted thereinto through the keyboard in the printer.

In the illustrated embodiment, CPU32 first discriminates whether or not the inputted selecting command is for the high density printing mode. If that selecting command is for the high density printing mode, CPU32 sets a flag for the high density printing mode.

If there is no high density selecting command, CPU32 then discriminates whether there is a selecting command for the normal density printing mode. If CPU32 discriminates that there is such a selecting command, CPU32 resets the set flag for the high density printing mode.

In such a manner, CPU32 can maintain its memory which relates to the high or normal density printing mode, by setting or resetting the flag for the high density printing mode. On setting or resetting the flag, the change of the character generator and paper feed pitch as in the prior art and the change of the impact power as being characterized in the present invention can be controlled.

Referring next to FIG. 8B, there will be described the function of the present invention wherein the change of the impact power is controlled by setting or resetting the flag in accordance with the normal or high density selecting command.

Firstly, the CPU 32 distinguishes the imprint mode of the high density imprint function or the normal density imprint function by reading a set/reset condition of settled high density imprint mode flag mentioned in the FIG. 8A. Being distinguished as the normal density imprint function mode, the CPU 32 latches the energizing time register 34 with the data value of 150 μS, and the energizing pulse signal 500 of 150 μS is outputted from the energizing pulse generator 36 to the hammer drive circuit 40 by way of the gate circuits 38 in accordance with the signal process mentioned above so that the normal density imprint function is performed.

On the other hand, in case of being distinguished as the high density imprint function mode, the data value of 140 μS is latched at the energizing time register 34, and the emerging pulse signal 500 of 140 μS is outputted from the energizing pulse generator 36 by the action of energizing trigger pulse signal 400. Thus, the energizing pulse signal 500 activates the hammer drive circuit 40 to perform the high density imprint function.

Moreover, this embodiment is composed in such a way that the imprinting impact energy is obtained by the stored force of the leaf spring, or the elastic restoring force of the leaf spring, but the means for the present invention is not limited to this kind of controlling method. The controlling method of the present invention can be applied to the various kinds of attracting types in which the hammer heads are attracted toward the printing paper, a piezoelectric transducing type in which the printing impact energy is obtained by piezoelectric transducing devices, a moving coil type in which the energy of the printing impact is obtained by application of moving coil, or the like.

Furthermore, in this embodiment, the printing impact is controlled by the energizing time of the solenoid 22, and it is also possible that the printing impact is controlled by the applied voltage of the energizing current.

As mentioned heretofore, according to the present invention, the high density impact function does not damage the printing paper, and characters can be printed out adequately.

In this case, a high density print-out can be obtained by proper, easy-to-read dots with high quality.

In accordance with the present invention, moreover, the impact power is changed by utilizing the normal/-high density imprint selecting commands which was used to change the character generator and paper feed pitch in the pior art. Therefore, the present invention does not require any particular command processing means, any additional counter means for counting the number of dots included in the printing data and any additional processing time period which was required to change the impact power in the prior art.

We claim:

1. A method for controlling printing impact energy in an impact type dot printer comprising the steps of:

distinguishing an imprint mode, whether it is normal character density printing mode or high character density printing mode, by reading a normal/high density selecting command being supplied into the printer by a CPU;

setting the printing impact energy during normal character density printing mode to a normal first level in response to selection of the normal density mode;

decreasing the printing impact energy to a second level during high character density printing mode wherein printing dots are overlapped in response to selection of the high character density, printing mode; and predetermining the energization time for normal and high character density printing modes to be fixed selectable values for the normal and high character densities respectively;

whereby damage to paper on which the printing is recorded is prevented during high character density printing.

2. A method for controlling printing impact in an impact type dot printer according to claim 1, wherein the amount of the printing impact energy is controlled by the energizing power supplied to a coil of an electromagnetic device.

3. A method for controlling printing impact in an impact type dot printer according to claim 2, wherein the amount of energizing power is controlled by switching over to a predetermined short energizing time duration or a long energizing time duration.

4. A method for controlling printing impact energy in an impact type dot printer comprising the steps of:

storing ON-time duration data in a ROM, said ON-time duration data comprising a first predetermined ON-time for a normal density printing and a second predetermined ON-time for a high density printing which is shorter than said first predetermined ON-time;

selectively reading out of said ROM said first or second predetermined ON-time by a CPU;

selectively latching said first or second predetermined ON-times into an energization time register by said CPU;

generating an energizing pulse signal in an energizing pulse generator of a duration equal to the ON-time of the selected first or second predetermined ON-times in response to said latching step and an energizing trigger pulse signal from said CPU; and generating high or normal density impact drive signals in response to a printing command and the duration of said energizing pulse signal;

whereby damage to paper on which the printing is recorded is prevented during high character density printing.

* * * * *